US007852293B2

(12) United States Patent
Park et al.

(10) Patent No.: US 7,852,293 B2
(45) Date of Patent: Dec. 14, 2010

(54) PLASMA DISPLAY APPARATUS AND DRIVING METHOD THEREOF

(75) Inventors: Hyunil Park, Seoul (KR); Isono Katsuo, Seoul (KR)

(73) Assignee: LG Electronics Inc., Seoul (KR)

( * ) Notice: Subject to any disclaimer, the term of this patent is extended or adjusted under 35 U.S.C. 154(b) by 420 days.

(21) Appl. No.: 12/109,755

(22) Filed: Apr. 25, 2008

(65) Prior Publication Data

US 2008/0266212 A1 Oct. 30, 2008

(30) Foreign Application Priority Data

Apr. 27, 2007 (KR) ..... 10-2007-0041625

(51) Int. Cl.
*G09G 3/28* (2006.01)

(52) U.S. Cl. ..... 345/63; 345/60

(58) Field of Classification Search ..... 345/60–67, 345/103; 315/169.4; 313/581
See application file for complete search history.

(56) References Cited

U.S. PATENT DOCUMENTS 4,077,033 A * 2/1978 Strom ..... 345/69
5,049,865 A * 9/1991 Nakamura et al. ..... 345/60
5,311,169 A * 5/1994 Inada et al. ..... 345/77
6,181,306 B1 * 1/2001 Specty et al. ..... 345/63
2005/0046647 A1 * 3/2005 Lee ..... 345/690

FOREIGN PATENT DOCUMENTS

JP 2002-297090 A 10/2002
KR 10-2003-0065286 A 8/2003
KR 10-2005-0099299 A 10/2005
KR 10-2005-0100531 A 10/2005

OTHER PUBLICATIONS

Korean Office Action dated Feb. 21, 2008.
Korean Decision to Grant a Patent dated Aug. 18, 2008.

* cited by examiner

*Primary Examiner*—Ricardo L Osorio
(74) *Attorney, Agent, or Firm*—Ked & Associates, LLP

(57) ABSTRACT

A plasma display apparatus is disclosed. The plasma display apparatus includes a plasma display panel including first and second scan electrode groups, a voltage supply unit supplying a scan bias voltage and a scan voltage, first and second charge delay units that receive the scan bias voltage from the voltage supply unit and supply the scan bias voltage to the first and second scan electrode groups, first and scan signal supply units, and first and second voltage return units. The first scan signal supply unit receives the scan voltage, supplies a scan signal, of which a lowest voltage is the scan voltage, to one scan electrode belonging to the first scan electrode group, and allows the other scan electrodes to be floated.

12 Claims, 5 Drawing Sheets

PLASMA DISPLAY APPARATUS AND DRIVING METHOD THEREOF

This application claims the benefit of Korean Patent Application No. 10-2007-0041625 filed on Apr. 27, 2007, which is hereby incorporated by reference.

BACKGROUND

1. Field

An exemplary embodiment relates to a plasma display apparatus.

2. Description of the Related Art

A plasma display apparatus includes a plasma display panel and a driver. The plasma display panel includes discharge cells partitioned by barrier ribs. When the driver supplies a driving signal to an electrode of the plasma display panel, a discharge occurs inside the discharge cell depending on the driving signal. The discharge excites a phosphor inside the discharge cell and allows the phosphor to emit light.

The plasma display apparatus represents a gray scale by a combination of subfields. More specifically, the plasma display apparatus emits light to the outside during each subfield and a gray scale is represented by a sum of the quantity of light emitted to the outside during each subfield.

Each subfield includes a reset period, an address period, and a sustain period. Wall charges are uniformly distributed inside all the discharge cells of the plasma display panel during the reset period. The discharge cells to emit light are selected during the address period. The selected discharge cells emit light during the sustain period.

The driver of the plasma display apparatus has to stably supply the driving signals so as to drive the plasma display panel.

SUMMARY

In one aspect, a plasma display apparatus comprises a plasma display panel including a first scan electrode group and a second scan electrode group, a voltage supply unit that supplies a scan bias voltage and a scan voltage, a first charge delay unit and a second charge delay unit that receive the scan bias voltage from the voltage supply unit and supply the scan bias voltage to the first scan electrode group and the second scan electrode group, a first scan signal supply unit that receives the scan voltage from the voltage supply unit, supplies a scan signal, of which a lowest voltage is the scan voltage, to one scan electrode belonging to the first scan electrode group, and allows the other scan electrodes of the first scan electrode group to be floated, a second scan signal supply unit that receives the scan voltage from the voltage supply unit, supplies a scan signal, of which a lowest voltage is the scan voltage, to one scan electrode belonging to the second scan electrode group, and allows the other scan electrodes of the second scan electrode group to be floated, and a first voltage return unit and a second voltage return unit that supply the scan bias voltage to the scan electrodes to which the scan signal is supplied.

A reference voltage of the scan bias voltage may be the scan voltage.

The first scan electrode group may include odd-numbed scan electrodes, and the second scan electrode group may include even-numbed scan electrodes.

A scan electrode belonging to the first scan electrode group and a scan electrode belonging to the second scan electrode group may be positioned to be adjacent to each other.

The scan voltage may correspond to a lowest voltage of the scan signal.

The first charge delay unit and the second charge delay unit may include a first resistor and a second resistor, respectively. One terminal of the first resistor may be connected to the voltage supply unit, and the other terminal is connected to a scan electrode belonging to the first scan electrode group. One terminal of the second resistor may be connected to the voltage supply unit, and the other terminal is connected to a scan electrode belonging to the second scan electrode group.

The first resistor and the second resistor may be a variable resistor.

The first scan signal supply unit may include a first switch including a first terminal connected to a scan electrode belonging to the first scan electrode group, a second terminal connected to the voltage supply unit, and a third terminal receiving a control signal. The second scan signal supply unit may include a second switch including a first terminal connected to a scan electrode belonging to the second scan electrode group, a second terminal connected to the voltage supply unit, and a third terminal receiving a control signal The first voltage return unit may include a first return switch including a first terminal connected to the voltage supply unit, a second terminal for supplying the scan bias voltage to a scan electrode belonging to the first scan electrode group, and a third terminal receiving a control signal. The second voltage return unit may include a second return switch including a first terminal connected to the voltage supply unit, a second terminal for supplying the scan bias voltage to a scan electrode belonging to the second scan electrode group, and a third terminal receiving a control signal.

The plasma display apparatus may further comprise a blocking diode for blocking a reverse current flowing from a scan electrode belonging to the first scan electrode group or the second scan electrode group to the first voltage return unit or the second voltage return unit.

The plasma display panel may further include a third scan electrode group and a fourth scan electrode group. The plasma display apparatus may further comprise a third charge delay unit and a fourth charge delay unit that receive the scan bias voltage from the voltage supply unit and supply the scan bias voltage to the third scan electrode group and the fourth scan electrode group, a third scan signal supply unit that receives the scan voltage from the voltage supply unit, supplies a scan signal, of which a lowest voltage is the scan voltage, to one scan electrode belonging to the third scan electrode group, and allows the other scan electrodes of the third scan electrode group to be floated, a fourth scan signal supply unit that receives the scan voltage from the voltage supply unit, supplies a scan signal, of which a lowest voltage is the scan voltage, to one scan electrode belonging to the fourth scan electrode group, and allows the other scan electrodes of the fourth scan electrode group to be floated, and a third voltage return unit and a fourth voltage return unit that supply the scan bias voltage to the scan electrodes to which the scan signal is supplied.

The first scan electrode group, the second scan electrode group, the third scan electrode group, and the fourth scan electrode group may include (4n−3)-th scan electrodes, (4n−2)-th scan electrodes, (4n−1)-th scan electrodes, and 4n-th scan electrodes, respectively, where n is a natural number.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
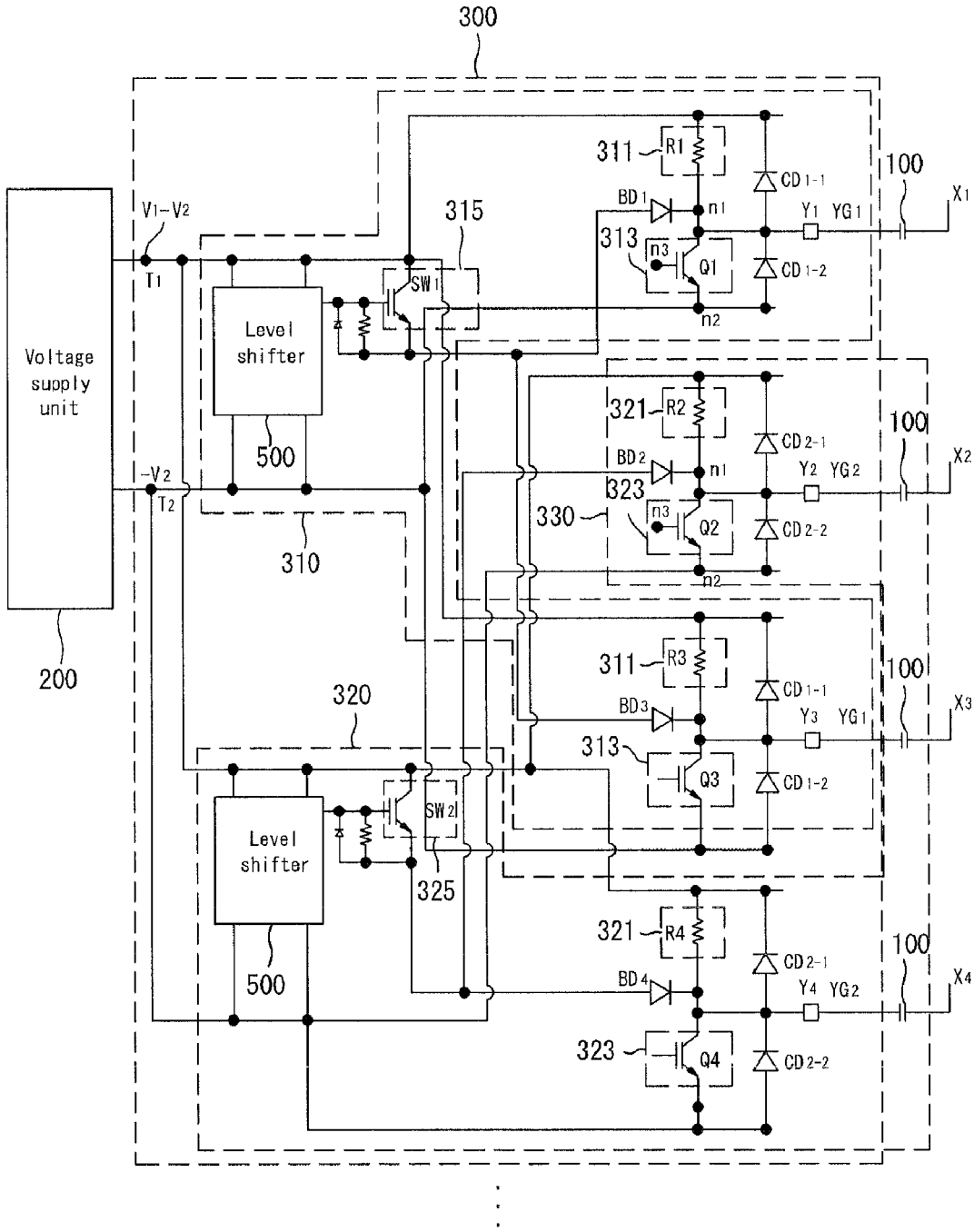
FIG. 1 shows a plasma display apparatus according to a first exemplary embodiment.

FIG. 1 shows a plasma display apparatus according to a first exemplary embodiment. As shown in FIG. 1, the plasma display apparatus according to the first exemplary embodiment includes a plasma display panel 100, a voltage supply unit 200, and a driver 300.

The plasma display panel 100 includes a first scan electrode group YG1, a second scan electrode group YG2, and data electrodes X1 to Xm. Scan electrodes belonging to the first scan electrode group YG1 and scan electrodes belonging to the second scan electrode group YG2 intersect the data electrodes X1 to Xm. The plasma display panel 100 includes discharge cells formed at each intersection. The scan electrodes belonging to the first scan electrode group YG1 and the scan electrodes belonging to the second scan electrode group YG2 may be adjacent to each other, or may not be adjacent to each other.

The voltage supply unit 200 supplies a scan bias voltage and a scan voltage. The scan bias voltage corresponds to a sum voltage (V1−V2) of a first voltage V1 and a second voltage −V2, and the scan voltage is a lowest voltage of a scan signal, i.e., the second voltage −V2. A reference voltage of the scan bias voltage supplied through a first terminal T1 of the voltage supply unit 200 may be the scan voltage, i.e., the second voltage −V2 supplied through a second terminal T2. Because the scan voltage is the reference voltage of the scan bias voltage, the voltage supply unit 200 does not have a separate circuit for supplying the scan voltage or the reference voltage of the scan bias voltage. Therefore, a configuration of the plasma display apparatus can be simplified.

The driver 300 receives the sum voltage (V1−V2) from the voltage supply unit 200 and supplies the scan bias voltage to the first scan electrode group YG1 and the second scan electrode group YG2. The driver 300 supplies a scan signal to one scan electrode belonging to the first scan electrode group YG1 and allows the other scan electrodes of the first scan electrode group YG1 to be floated. The driver 300 supplies a scan signal to one scan electrode belonging to the second scan electrode group YG2 and allows the other scan electrodes of the second scan electrode group YG2 to be floated. The second voltage −V2 corresponds to a lowest voltage of the scan signal.

The driver 300 includes a first electrode group driver 310 and a second electrode group driver 320. The first electrode group driver 310 includes a first charge delay unit 311, a first scan signal supply unit 313, and a first voltage return unit 315. The second electrode group driver 320 includes a second charge delay unit 321, a second scan signal supply unit 323, and a second voltage return unit 325.

The first charge delay unit 311 and the second charge delay unit 321 receive the sum voltage (V1−V2) from the voltage supply unit 200, and supply the scan bias voltage to the first scan electrode group YG1 and the second scan electrode group YG2. The scan bias voltage is substantially equal to the sum voltage (V1−V2). The first charge delay unit 311 and the second charge delay unit 321 include first resistors R1 and R3 and second resistors R2 and R4, respectively. One terminal of each of the first resistors R1 and R3 is connected to the voltage supply unit 200, and the other terminals are connected to scan electrodes Y1 and Y3 belonging to the first scan electrode group YG1, respectively. One terminal of each of the second resistors R2 and R4 is connected to the voltage supply unit 200, and the other terminals are connected to scan electrodes Y2 and Y4 belonging to the second scan electrode group YG2, respectively.

The first scan signal supply unit 313 receives the second voltage −V2 from the voltage supply unit 200. Then, the first scan signal supply unit 313 supplies a scan signal, of which a lowest voltage is the second voltage −V2, to one scan electrode belonging to the first scan electrode group YG1, and allows the other scan electrodes to be floated. The first scan signal supply unit 313 includes first switches Q1 and Q3. The first switch Q1 includes a first terminal connected to a common terminal of the other terminal of the first resistor R1 and the scan electrode Y1, a second terminal connected to the voltage supply unit 200, and a third terminal receiving a control signal. The first switch Q3 includes a first terminal connected to a common terminal of the other terminal of the first resistor R3 and the scan electrode Y3, a second terminal connected to the voltage supply unit 200, and a third terminal receiving a control signal.

The second scan signal supply unit 323 receives the second voltage −V2 from the voltage supply unit 200. Then, the second scan signal supply unit 323 supplies a scan signal, of which a lowest voltage is the second voltage −V2, to one scan electrode belonging to the second scan electrode group YG2, and allows the other scan electrodes to be floated. The second scan signal supply unit 323 includes second switches Q2 and Q4. The second switch Q2 includes a first terminal connected to a common terminal of the other terminal of the second resistor R2 and the scan electrode Y2, a second terminal connected to the voltage supply unit 200, and a third terminal receiving a control signal. The second switch Q4 includes a first terminal connected to a common terminal of the other terminal of the second resistor R4 and the scan electrode Y4, a second terminal connected to the voltage supply unit 200, and a third terminal receiving a control signal.

The first voltage return unit 315 supplies the scan bias voltage to the scan electrode to which the first scan signal supply unit 313 supplies the scan signal. The first voltage return unit 315 includes a first return switch SW1. The first return switch SW1 includes a first terminal connected to the voltage supply unit 200, a second terminal for supplying the scan bias voltage to all the scan electrodes belonging to the first scan electrode group YG1, and a third terminal receiving a control signal.

The second voltage return unit 325 supplies the scan bias voltage to the scan electrode, to which the second scan signal supply unit 323 supplies the scan signal, and the other scan electrodes. The second voltage return unit 325 includes a second return switch SW2. The second return switch SW2 includes a first terminal connected to the voltage supply unit 200, a second terminal for supplying the scan bias voltage to all the scan electrodes belonging to the second scan electrode group YG2, and a third terminal receiving a control signal.

The driver 300 includes blocking diodes BD1 to BD4 for blocking a reverse current. The second terminal of the first return switch SW1 is connected to anodes of the blocking diodes BD1 and BD3, and cathodes of the blocking diodes BD1 and BD3 are connected to the scan electrodes Y1 and Y3. The second terminal of the second return switch SW2 is connected to anodes of the blocking diodes BD2 and BD4, and cathodes of the blocking diodes BD2 and BD4 are connected to the scan electrodes Y2 and Y4.

A voltage of the scan electrodes, to which the scan signal is supplied, rises from the second voltage −V2 to the scan bias voltage depending on operations of the first voltage return unit 315 and the second voltage return unit 325, and the other scan electrodes are held at the scan bias voltage.

Reference numerals CD1-1, CD1-2, CD2-1, and CD2-2 indicate a clamping diode that allows a voltage of the scan electrodes Y1 to Y4 not to be equal to or higher than or equal to or lower than a predetermined voltage. A reference numeral 500 indicates a level shifter that outputs a control signal for controlling turn-on and -off operations of the first return switch SW1 or the second return switch SW2. The first return switch SW1 or the second return switch SW2 may receive the control signal of the turn-on and -off operations from not the level shifter 500 but another controller. Further, the first return switch SW1 or the second return switch SW2 may receive the control signal of the turn-on and -off operations from not the level shifter 500 but an external device of the driver 300.

Figure 2:
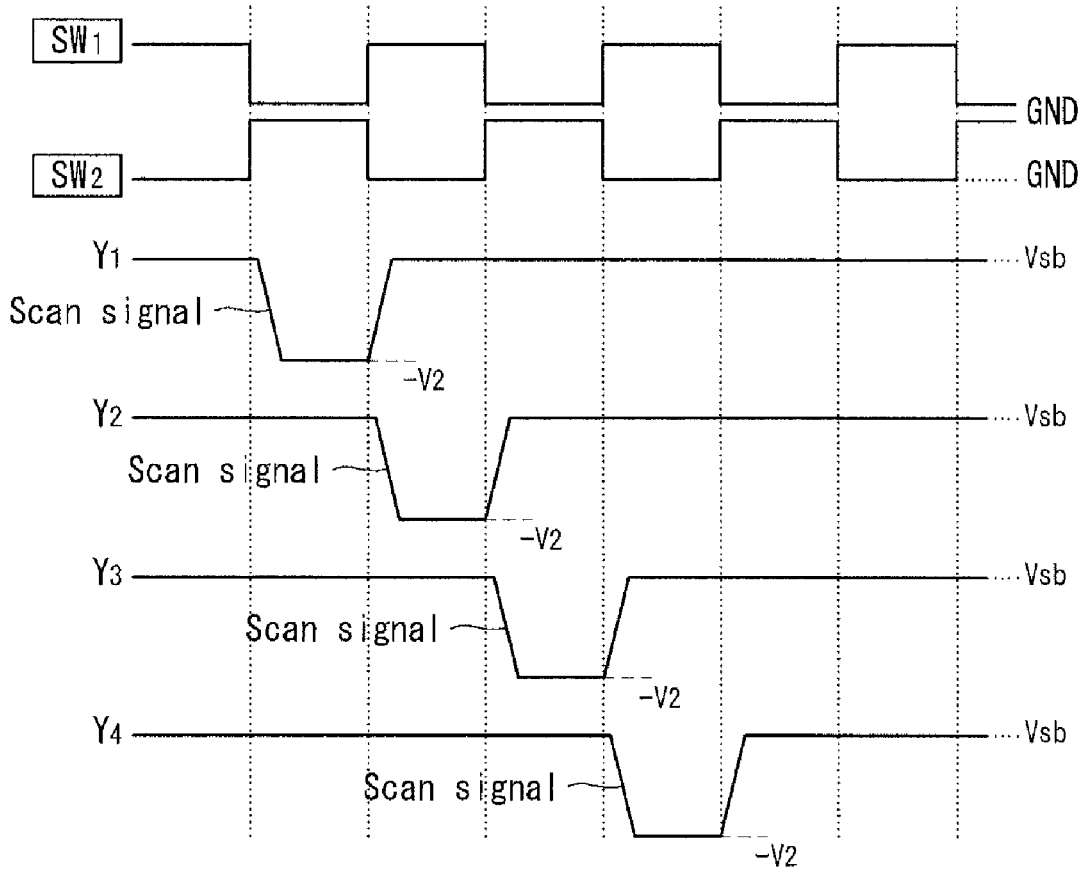
FIG. 2 is a switching timing diagram of the plasma display apparatus according to the first exemplary embodiment.

FIG. 2 is a switching timing diagram of the plasma display apparatus according to the first exemplary embodiment. In FIG. 2, the scan electrodes Y1 and Y3 belong to the first scan electrode group YG1, and the scan electrodes Y2 and Y4 belong to the second scan electrode group YG2.

The first charge delay unit 311 and the second charge delay unit 321 receive the sum voltage (V1−V2) from the voltage supply unit 200 and supply a scan bias voltage Vsb to the first scan electrode group YG1 and the second scan electrode group YG2. More specifically, the sum voltage (V1−V2) is supplied to the scan electrodes Y1 to Y4 through one terminal of each of the first charge delay unit 311 and the second charge delay unit 321. Hence, the plasma display panel 100 is charged until a voltage of the scan electrodes Y1 to Y4 reaches the sum voltage (V1−V2). When the voltage of the scan electrodes Y1 to Y4 reaches the sum voltage (V1−V2), there are no voltage differences between both terminals of the first charge delay unit 311 and between both terminals of the second charge delay unit 321. Therefore, a current does not flow into the first charge delay unit 311 and the second charge delay unit 321.

A charge time of the plasma display panel 100 can be adjusted depending on magnitudes of resistances of the first charge delay unit 311 and the second charge delay unit 321. In case the first resistors R1 and R3 of the first charge delay unit 311 and the second resistors R2 and R4 of the second charge delay unit 321 are a variable resistor, a charge time of the plasma display panel 100 can be adjusted without replacement of the resistors R1 to R4.

The first switch Q1 of the first scan signal supply unit 313 is turned on. Hence, the first scan signal supply unit 313 receives the second voltage −V2 from the voltage supply unit 200 and supplies the scan signal, of which a lowest voltage is the second voltage −V2, to the scan electrode Y1.

The switch Q3 of the first scan signal supply unit 313 and the switches Q2 and Q4 of the second scan signal supply unit 323 are turned off during the supply of the scan signal to the scan electrode Y1. The first return switch SW1 is turned off, and the second return switch SW2 is turned on.

Because the first return switch SW1 and the switch Q3 are turned off and the current does not flow into the first charge delay unit 311, the scan electrode Y3 is floated. Because the scan electrode Y3 is floated and the plasma display panel 100 is charged to the scan bias voltage, the scan electrode Y3 is held at the scan bias voltage Vsb. Because the second return switch SW2 is turned on, the scan bias voltage Vsb corresponding to the sum voltage (V1−V2) is supplied to the second scan electrode group YG2.

The first return switch SW1 is turned on, and the second return switch SW2 is turned off. The switches Q1, Q3, and Q4 are turned off, and the switch Q2 is turned on. Hence, a voltage of the scan electrode Y1 rises from the second voltage −V2 to the scan bias voltage Vsb, and the scan bias voltage Vsb is supplied to the scan electrode Y3. A scan signal of which a lowest voltage is the second voltage −V2 is supplied to the scan electrode Y2 as the switch Q2 is turned on. Because the second return switch SW2 and the switch Q4 are turned off, the scan electrode Y4 is floated. Hence, the scan electrode Y4 is held at the scan bias voltage Vsb.

The second return switch SW2 is turned on, and the first return switch SW1 is turned off. The switches Q1, Q2, and Q4 are turned off, and the switch Q3 is turned on. Hence, a voltage of the scan electrode Y2 rises from the second voltage −V2 to the scan bias voltage Vsb, and the scan bias voltage Vsb is supplied to the scan electrode Y4. A scan signal of which a lowest voltage is the second voltage −V2 is supplied to the scan electrode Y3 as the switch Q3 is turned on. Because the first return switch SW1 and the switch Q1 are turned off, the scan electrode Y1 is floated. Hence, the scan electrode Y1 is held at the scan bias voltage Vsb.

The first return switch SW1 is turned on, and the second return switch SW2 is turned off. The switches Q1, Q2, and Q3 are turned off, and the switch Q4 is turned on. Hence, a voltage of the scan electrode Y3 rises from the second voltage −V2 to the scan bias voltage Vsb, and the scan bias voltage Vsb is supplied to the scan electrode Y1. A scan signal of which a lowest voltage is the second voltage −V2 is supplied to the scan electrode Y4 as the switch Q4 is turned on. Because the second return switch SW2 and the switch Q2 are turned off, the scan electrode Y2 is floated. Hence, the scan electrode Y2 is held at the scan bias voltage Vsb.

As described above, the plasma display apparatus according to the first exemplary embodiment drives the odd-numbered scan electrodes Y1 and Y3 and the even-numbered scan electrodes Y2 and Y4 independent of each other. Although the odd-numbered scan electrode is adjacent to the even-numbered scan electrode (for example, the scan electrode Y1 is adjacent to the scan electrode Y2, the scan electrode Y2 is adjacent to the scan electrode Y3, or the scan electrode Y3 is adjacent to the scan electrode Y4), an influence of changes in a voltage of the odd-numbered scan electrode or the even-numbered scan electrode on the adjacent scan electrode decreases.

For example, when a scan signal is supplied to the scan electrode Y1, the second return switch SW2 is turned on and thus the scan bias voltage Vsb is supplied to the scan electrode Y2. Therefore, a voltage of the scan electrode Y2 is prevented from changing by the supply of the scan signal.

When a scan signal is supplied to one scan electrode belonging to the scan electrode group, the other scan electrodes of the scan electrode group are floated. Therefore, all the scan electrodes belonging to the scan electrode group can be driven through operations of one return switch. For example, when the first return switch SW1 is turned off and the scan signal is supplied to the scan electrode Y1, the scan electrode Y3 is floated and held at the scan boas voltage.

Although the scan signals are sequentially supplied to the scan electrodes Y1, Y2, Y3, and Y4 in the first exemplary embodiment, supply order of the scan signal may change. For example, when the first return switch SW1 and the switch Q2 are turned on and the second return switch SW2 and the switches Q1, Q3, and Q4 are turned off, the scan signal is supplied to the scan electrode Y2. Then, when the second return switch SW2 and the switch Q1 are turned on and the first return switch SW1 and the switches Q2, Q3, and Q4 are turned off, the scan signal is supplied to the scan electrode Y1.

Figure 3:
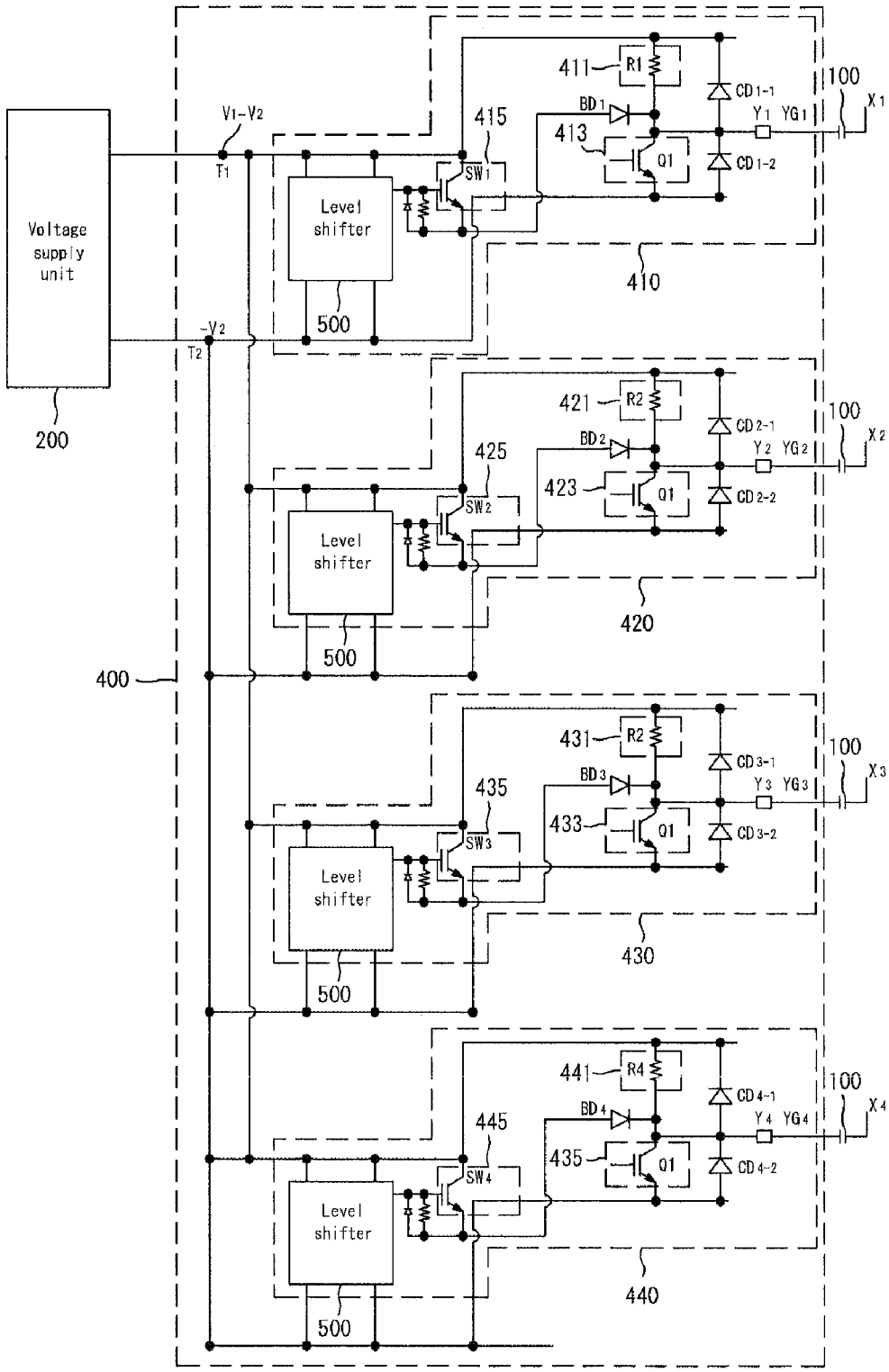
FIG. 3 shows a plasma display apparatus according to a second exemplary embodiment.

FIG. 3 shows a plasma display apparatus according to a second exemplary embodiment. The first exemplary embodiment described the case where the odd-numbered scan electrode and the even-numbered scan electrode are driven independent of each other, and the second exemplary embodiment will describe the case where four scan electrode groups are driven independent of one another when all the scan electrodes are divided into the four scan electrode groups.

A plasma display panel 100 includes a first scan electrode group YG1, a second scan electrode group YG2, a third scan electrode group YG3, a fourth scan electrode group YG4, and data electrodes X1 to X4. Scan electrodes Y1 to Y4 belonging to the scan electrode groups YG1 to YG4 intersect the data electrodes X1 to X4. The plasma display panel lo includes discharge cells formed at each intersection.

For example, the first scan electrode group YG1, the second scan electrode group YG2, the third scan electrode group YG3, and the fourth scan electrode group YG4 may include (4n−3)-th scan electrodes, (4n−2)-th scan electrodes, (4n−1)-th scan electrodes, and 4n-th scan electrodes, respectively, where n is a natural number. More specifically, the first scan electrode group YG1 may include scan electrodes Y1, Y5, . . . , $Y_{(4n-3)}$, the second scan electrode group YG2 may include scan electrodes Y2, Y6, . . . , $Y_{(4n-2)}$, the third scan electrode group YG3 may include scan electrodes Y3, Y7, . . . , $Y_{(4n-1)}$, and the fourth scan electrode group YG4 may include scan electrodes Y4, Y8, . . . , $Y_{4n}$.

A voltage supply unit 200 supplies a scan bias voltage and a scan voltage. The scan bias voltage corresponds to a sum voltage (V1−V2) of a first voltage V1 and a second voltage −V2, and the scan voltage is a lowest voltage of a scan signal, i.e., the second voltage −V2. A reference voltage of the scan bias voltage supplied through a first terminal T1 of the voltage supply unit 200 may be the scan voltage, i.e., the second voltage −V2 supplied through a second terminal T2.

A driver 400 receives the sum voltage (V1−V2) from the voltage supply unit 200 and supplies the scan bias voltage to the first to fourth scan electrode groups YG1 to YG4. When the driver 400 supplies a scan signal to one scan electrode belonging to the specific scan electrode group of the first to fourth scan electrode groups YG1 to YG4, the driver 400 allows the other scan electrodes of the specific scan electrode group to be floated, in the same way as the first exemplary embodiment. The second voltage −V2 corresponds to a lowest voltage of the scan signal.

The driver 400 includes first, second, third, and fourth electrode group drivers 410, 420, 430, and 440. The first, second, third, and fourth electrode group drivers 410, 420, 430, and 440 include a first, second, third, and fourth charge delay units 411, 421, 431, and 441, first, second, third, and fourth scan signal supply units 413, 423, 433, and 443, and first, second, third, and fourth voltage return units 415, 425, 435, and 445, respectively.

The first to fourth charge delay units 411 to 441 receive the sum voltage (V1−V2) from the voltage supply unit 200, and supply the scan bias voltage to the first to fourth scan electrode groups YG1 to YG4, respectively. The scan bias voltage is substantially equal to the sum voltage (V1−V2). The first, second, third, and fourth charge delay units 411, 421, 431, and 441 include first, second, third, and fourth resistors R1, R2, R3, and R4, respectively. Since a connection relationship of each of the first to fourth resistors R1 to R4 is the same as the connection relationship described in the first exemplary embodiment, a description thereabout is omitted.

The first to fourth scan signal supply units 413 to 443 receive the second voltage −V2 from the voltage supply unit 200. Then, one of the first to fourth scan signal supply units 413 to 443 supplies a scan signal, of which a lowest voltage is the second voltage −V2, to one scan electrode belonging to the corresponding scan electrode group, and allows the other scan electrodes of the corresponding scan electrode group to be floated. The first to fourth scan signal supply units 413 to 443 include first to fourth switches Q1 to Q4, respectively. Since a connection relationship of each of the first to fourth switches Q1 to Q4 is the same as the connection relationship described in the first exemplary embodiment, a description thereabout is omitted.

The first to fourth voltage return units 415 to 445 supply the scan bias voltage to the scan electrodes, to which the scan signal having the second voltage −V2 as the lowest voltage is supplied. The first to fourth voltage return units 415 to 445 include first to fourth voltage return switches SW1 to SW4, respectively. Since a connection relationship of each of the first to fourth voltage return switches SW1 to SW4 is the same as the connection relationship described in the first exemplary embodiment, a description thereabout is omitted.

The driver 400 includes blocking diodes BD1 to BD4 for blocking a reverse current.

Reference numerals CD1-1, CD1-2, CD2-1, CD2-2, CD3-1, CD3-2, CD4-1, and CD4-2 indicate a clamping diode that allows a voltage of the scan electrodes Y1 to Y4 not to be equal to or higher than or equal to or lower than a predetermined voltage. A reference numeral 500 indicates a level shifter that outputs a control signal for controlling turn-on and -off operations of the first to fourth return switches SW1 to SW4.

Figure 4:
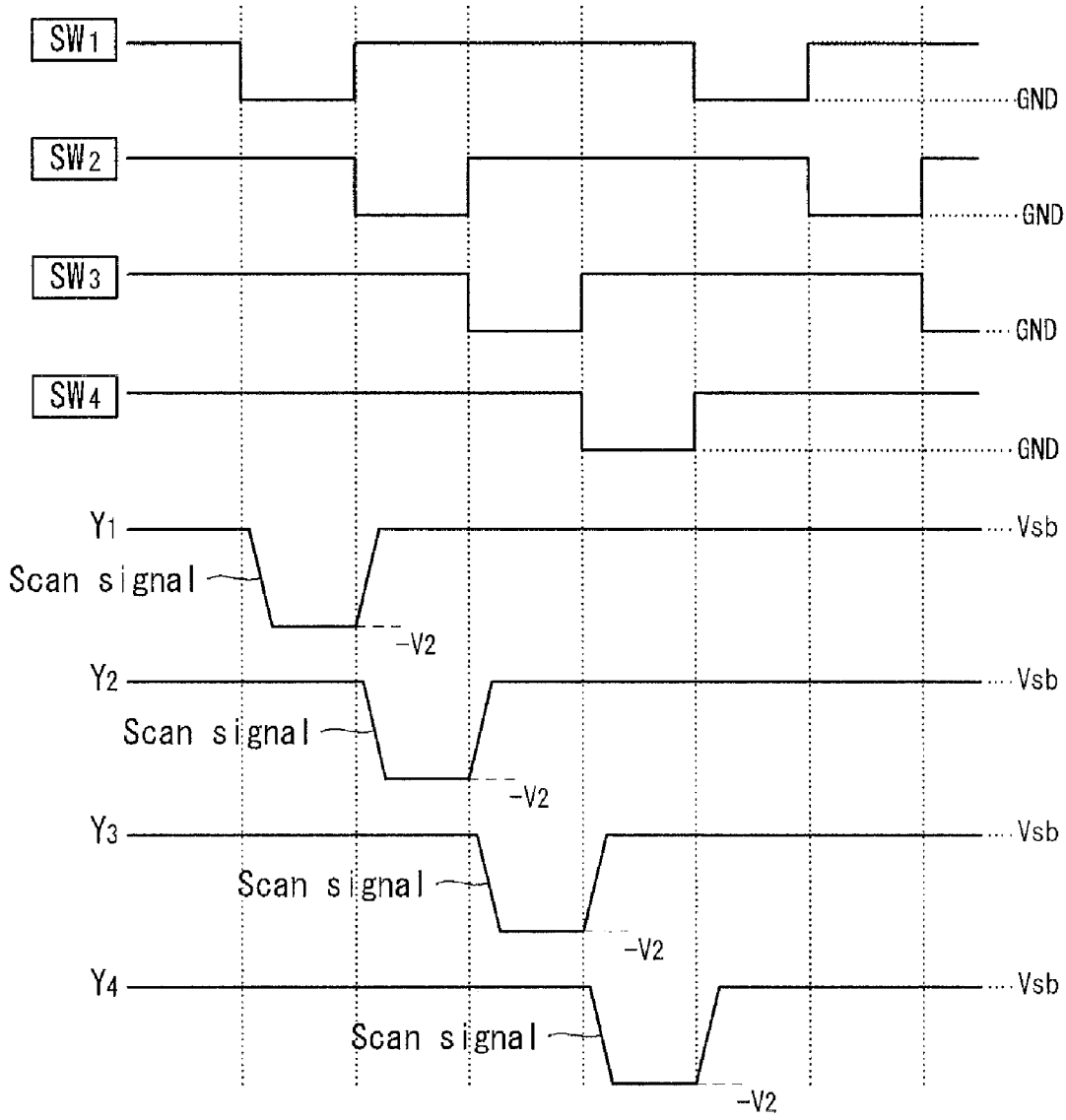
FIG. 4 is a switching timing diagram of the plasma display apparatus according to the second exemplary embodiment.

FIG. 4 is a switching timing diagram of the plasma display apparatus according to the second exemplary embodiment. In FIG. 4, the scan electrodes Y1, Y2, Y3, and Y4 belong to the first scan electrode group YG1, the second scan electrode group YG2, the third scan electrode group YG3, and the fourth scan electrode group YG4, respectively, The first to fourth charge delay units 411 to 441 receive the sum voltage (V1−V2) from the voltage supply unit 200 and supply a scan bias voltage Vsb to the first to fourth scan electrode groups YG1 to YG4, respectively. More specifically, the sum voltage (V1−V2) is supplied to the scan electrodes Y1 to Y4 through one terminal of each of the first to fourth charge delay units 411 to 441. Hence, the plasma display panel 100 is charged until a voltage of the scan electrodes Y1 to Y4 reaches the sum voltage (V1−V2).

The switch Q1 of the first scan signal supply unit 413 is turned on, and thus the scan signal is supplied to the scan electrode Y1. The switches Q2, Q3, and Q4 of the second to fourth scan signal supply units 421 to 441 are turned off. The first return switch SW1 is turned off, and the second to fourth return switches SW2 to SW4 are turned on. Hence, the scan bias voltage Vsb is supplied to the second to fourth scan electrode groups YG2 to YG4. The scan bias voltage Vsb is equal to the sum voltage (V1−V2). Although it is not shown in FIG. 3, the scan electrodes Y5, Y9, . . . , $Y_{(4n-3)}$ belonging to the first scan electrode group YG1 are floated. Hence, the scan electrodes Y5, Y9, . . . , $Y_{(4n-3)}$ are held at the scan bias voltage Vsb.

The first, third, and fourth return switches SW1, SW3, and SW4 are turned on, and the second return switch SW2 is turned off. The switches Q1, Q3, and Q4 are turned off, and the switch Q2 is turned on. Hence, a voltage of the scan electrode Y1 rises from the second voltage −V2 to the scan bias voltage Vsb, and the scan electrodes Y3 and Y4 are held at the scan bias voltage Vsb. Further, the scan signal falling to the second voltage −V2 is supplied to the scan electrode Y2. Although it is not shown in FIG. 3, the scan electrodes Y6, Y10, . . . , $Y_{(4n-2)}$ belonging to the second scan electrode group YG2 are floated. Hence, the scan electrodes Y6, Y10, . . . , $Y_{(4n-2)}$ are held at the scan bias voltage Vsb.

In other words, because the plasma display panel 100 is charged by supplying the scan bias voltage Vsb, the scan electrodes Y6, Y10, . . . , $Y_{(4n-2)}$ belonging to the second scan electrode group YG2 are floated and held at the scan bias voltage Vsb.

The first, second, and fourth return switches SW1, SW2, and SW4 are turned on, and the third return switch SW3 is turned off. The switches Q1, Q2, and Q4 are turned off, and the switch Q3 is turned on. Hence, a voltage of the scan electrode Y2 rises from the second voltage −V2 to the scan bias voltage Vsb, and the scan electrodes Y1 and Y4 are held at the scan bias voltage Vsb. Further, the scan signal falling to the second voltage −V2 is supplied to the scan electrode Y3. Although it is not shown in FIG. 3, the scan electrodes Y7, Y10, . . . , $Y_{(4n-1)}$ belonging to the third scan electrode group YG3 are floated. Hence, the scan electrodes Y7, Y11, . . . , $Y_{(4n-1)}$ are held at the scan bias voltage Vsb.

The first, second, and third return switches SW1, SW2, and SW3 are turned on, and the fourth return switch SW4 is turned off. The switches Q1, Q2, and Q3 are turned off, and the switch Q4 is turned on. Hence, a voltage of the scan electrode Y3 rises from the second voltage −V2 to the scan bias voltage Vsb, and the scan electrodes Y1 and Y2 are held at the scan bias voltage Vsb. Further, the scan signal falling to the second voltage −V2 is supplied to the scan electrode Y4. Although it is not shown in FIG. 3, the scan electrodes Y8, Y12, . . . , $Y_{4n}$ belonging to the fourth scan electrode group YG4 are floated. Hence, the scan electrodes Y8, Y12, . . . , $Y_{4n}$ are held at the scan bias voltage Vsb.

As described above, the plasma display apparatus according to the second exemplary embodiment drives the four scan electrode groups independent of each other. An influence of changes in a voltage of the scan electrode Y1 on the scan electrodes Y2, Y3, and Y4 adjacent to the scan electrode Y1 decreases.

For example, when a scan signal is supplied to the scan electrode Y1, the second return switch SW2 is turned on and thus the scan bias voltage Vsb is supplied to the scan electrode Y2. Therefore, a voltage of the scan electrode Y2 is prevented from changing by the supply of the scan signal.

Although the scan signals are sequentially supplied to the scan electrodes Y1, Y2, Y3, and Y4 in the second exemplary embodiment, supply order of the scan signal may change.

Figure 5:
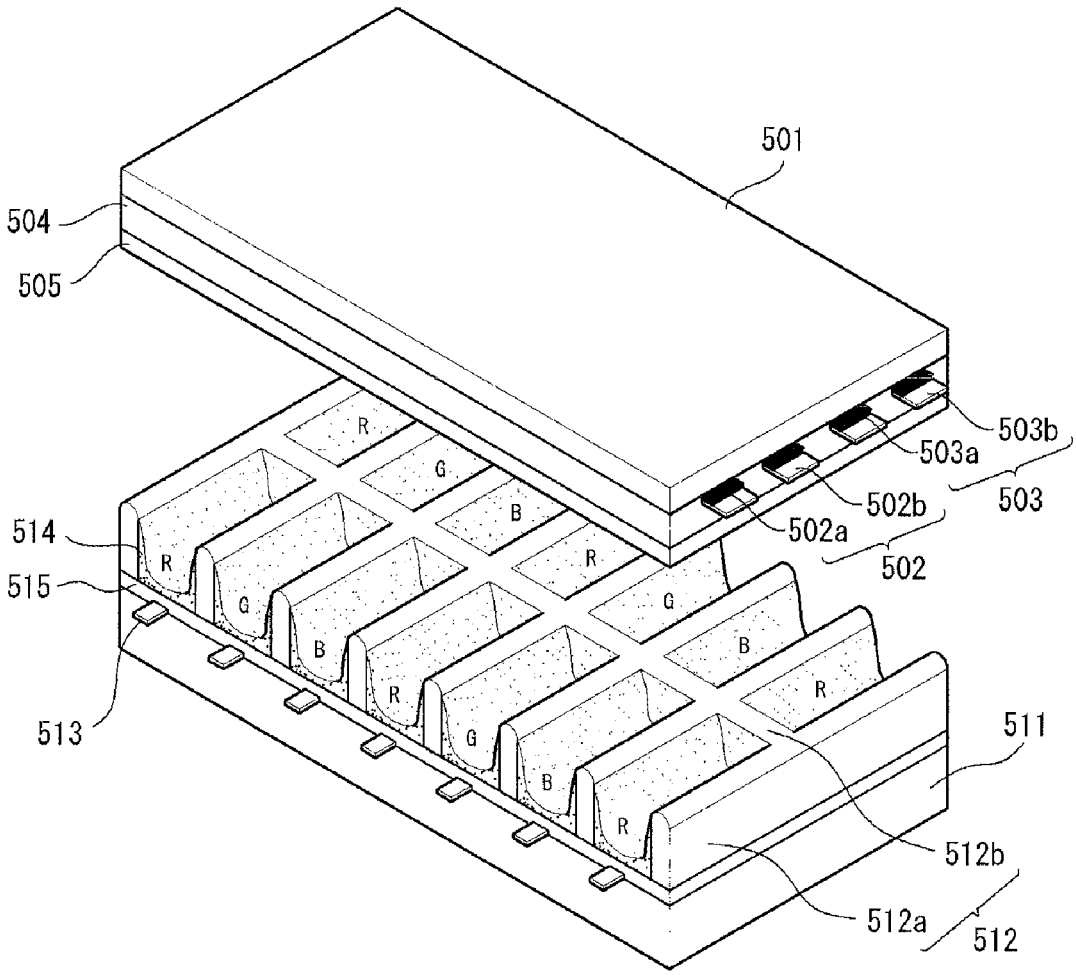
FIG. 5 shows a plasma display panel applicable to the plasma display apparatus of FIGS. 1 to 4.

FIG. 5 shows a plasma display panel applicable to the plasma display apparatus of FIGS. 1 to 4. As shown in FIG. 5, an upper dielectric layer 504 covering a scan electrode 502 and a sustain electrode 503 is positioned on a front substrate 501. The upper dielectric layer 504 limits a discharge current of the scan electrode 502 and the sustain electrode 503 and provides insulation between the scan electrode 502 and the sustain electrode 503.

A protective layer 505 is positioned on an upper surface of the upper dielectric layer 504 to facilitate discharge conditions. The protective layer 505 may be formed by depositing a material such as MgO on the upper surface of the upper dielectric layer 504.

A lower dielectric layer 515 is positioned on a rear substrate 511, on which an address electrode 513 is positioned, to cover the address electrode 513. The lower dielectric layer 515 provides insulation between address electrodes 513.

A plurality of barrier ribs 512 are positioned on the lower dielectric layer 515 to form a plurality of discharge cells. The discharge cells may include a red discharge cell R emitting red light, a green discharge cell G emitting green light, and a blue discharge cell B emitting blue light. The barrier ribs 512 may include a first barrier rib 512*b* and a second barrier rib 512*a* crossing each other. A height of the first barrier rib 512*b* may be different from a height of the second barrier rib 512*a*.

A phosphor layer 514 emitting visible light is positioned between the barrier ribs 512. The phosphor layer 514 may include a red phosphor layer, a green phosphor layer, and a blue phosphor layer. The phosphor layer 514 may further include at least one of a white phosphor layer or a yellow phosphor layer.

The scan electrode 502 and the sustain electrode 503 may include transparent electrodes 502*a* and 503*a* and bus electrodes 502*b* and 503*b*.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including a first scan electrode group and a second scan electrode group;

a voltage supply unit that supplies a scan bias voltage and a scan voltage;

a first charge delay unit and a second charge delay unit that receive the scan bias voltage from the voltage supply unit and supply the scan bias voltage to the first scan electrode group and the second scan electrode group;

a first scan signal supply unit that receives the scan voltage from the voltage supply unit, supplies a scan signal, of which a lowest voltage is the scan voltage, to one scan electrode belonging to the first scan electrode group, and allows the other scan electrodes of the first scan electrode group to be floated;

a second scan signal supply unit that receives the scan voltage from the voltage supply unit, supplies a scan signal, of which a lowest voltage is the scan voltage, to one scan electrode belonging to the second scan electrode group, and allows the other scan electrodes of the second scan electrode group to be floated; and a first voltage return unit and a second voltage return unit that supply the scan bias voltage to the scan electrodes to which the scan signal is supplied.

2. The plasma display apparatus of claim 1, wherein a reference voltage of the scan bias voltage is the scan voltage.

3. The plasma display apparatus of claim 1, wherein the first scan electrode group includes odd-numbed scan electrodes, and the second scan electrode group includes even-numbed scan electrodes.

4. The plasma display apparatus of claim 1, wherein a scan electrode belonging to the first scan electrode group and a scan electrode belonging to the second scan electrode group are positioned to be adjacent to each other.

5. The plasma display apparatus of claim 1, wherein the scan voltage corresponds to a lowest voltage of the scan signal.

6. The plasma display apparatus of claim 1, wherein the first charge delay unit and the second charge delay unit include a first resistor and a second resistor, respectively, one terminal of the first resistor is connected to the voltage supply unit, and the other terminal is connected to a scan electrode belonging to the first scan electrode group, and one terminal of the second resistor is connected to the voltage supply unit, and the other terminal is connected to a scan electrode belonging to the second scan electrode group.

7. The plasma display apparatus of claim 6, wherein the first resistor and the second resistor are a variable resistor.

8. The plasma display apparatus of claim 1, wherein the first scan signal supply unit includes a first switch including a first terminal connected to a scan electrode belonging to the first scan electrode group, a second terminal connected to the voltage supply unit, and a third terminal receiving a control signal, and the second scan signal supply unit includes a second switch including a first terminal connected to a scan electrode belonging to the second scan electrode group, a second terminal connected to the voltage supply unit, and a third terminal receiving a control signal.

9. The plasma display apparatus of claim 1, wherein the first voltage return unit includes a first return switch including a first terminal connected to the voltage supply unit, a second terminal for supplying the scan bias voltage to a scan electrode belonging to the first scan electrode group, and a third terminal receiving a control signal, and the second voltage return unit includes a second return switch including a first terminal connected to the voltage supply unit, a second terminal for supplying the scan bias voltage to a scan electrode belonging to the second scan electrode group, and a third terminal receiving a control signal.

10. The plasma display apparatus of claim 1, further comprising a blocking diode for blocking a reverse current flowing from a scan electrode belonging to the first scan electrode group or the second scan electrode group to the first voltage return unit or the second voltage return unit.

11. The plasma display apparatus of claim 1, wherein the plasma display panel further includes a third scan electrode group and a fourth scan electrode group, and further comprising:

a third charge delay unit and a fourth charge delay unit that receive the scan bias voltage from the voltage supply unit and supply the scan bias voltage to the third scan electrode group and the fourth scan electrode group;

a third scan signal supply unit that receives the scan voltage from the voltage supply unit, supplies a scan signal, of which a lowest voltage is the scan voltage, to one scan electrode belonging to the third scan electrode group, and allows the other scan electrodes of the third scan electrode group to be floated;

a fourth scan signal supply unit that receives the scan voltage from the voltage supply unit, supplies a scan signal, of which a lowest voltage is the scan voltage, to one scan electrode belonging to the fourth scan electrode group, and allows the other scan electrodes of the fourth scan electrode group to be floated; and a third voltage return unit and a fourth voltage return unit that supply the scan bias voltage to the scan electrodes to which the scan signal is supplied.

12. The plasma display apparatus of claim 11, wherein the first scan electrode group, the second scan electrode group, the third scan electrode group, and the fourth scan electrode group include (4n−3)-th scan electrodes, (4n−2)-th scan electrodes, (4n−1)-th scan electrodes, and 4n-th scan electrodes, respectively, where n is a natural number.

* * * * *